US007372431B2

(12) United States Patent
Kang et al.

(10) Patent No.: US 7,372,431 B2
(45) Date of Patent: May 13, 2008

(54) METHOD FOR DRIVING DISCHARGE DISPLAY PANEL BY ADDRESS-DISPLAY MIXING

(75) Inventors: Kyoung-Ho Kang, Suwon-si (KR); Woo-Joon Jeong, Asan-si (KR); Jin-Sung Kim, Cheonan-si (KR); Seung-Hun Chae, Suwon-si (KR); Tae-Seong Kim, Cheonan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 638 days.

(21) Appl. No.: 10/915,370

(22) Filed: Aug. 11, 2004

(65) Prior Publication Data

US 2005/0035929 A1 Feb. 17, 2005

(30) Foreign Application Priority Data

Aug. 12, 2003 (KR) ..... 10-2003-0055875
Oct. 29, 2003 (KR) ..... 10-2003-0075806

(51) Int. Cl.
*G09G 3/28* (2006.01)

(52) U.S. Cl. ..... 345/60

(58) Field of Classification Search ..... 345/60, 345/62, 66, 37; 315/169.1, 169.4; 313/491, 313/581

See application file for complete search history.

(56) References Cited

U.S. PATENT DOCUMENTS 6,989,802 B2 * 1/2006 Mizobata ..... 345/60

FOREIGN PATENT DOCUMENTS

JP 2001-184022 7/2001
KR 10-2001-0002395 1/2001

OTHER PUBLICATIONS

Y. Tanaka, et al., "A New Progressive Driving Scheme for a PDP with "CASTLE" Structure", ASID/IDWO1 PDP6- Dec. 4, 2001, pp. 869-872.

* cited by examiner

*Primary Examiner*—Richard Hjerpe
*Assistant Examiner*—Abbas I. Abdulselam
(74) *Attorney, Agent, or Firm*—H.C. Park & Associates, PLC

(57) ABSTRACT

A method for driving a discharge display panel provides at least a first type sub-filed and a second type sub-field that are used alternately over the span of at least a sub-field. The first type sub-field sequentially includes an addressing time for a first display electrode-line group, a display-sustain time for the first display electrode-line group, an addressing time for a second display electrode-line group, and a display-sustain time for the first display electrode-line group and the second display electrode-line group. Each of the second type sub-fields sequentially includes an addressing time for a second display electrode-line group, a display-sustain time for the second display electrode-line group, an addressing time for the first display electrode-line group, and a display-sustain time for the first display electrode-line group and the second display electrode-line group.

21 Claims, 6 Drawing Sheets

METHOD FOR DRIVING DISCHARGE DISPLAY PANEL BY ADDRESS-DISPLAY MIXING

BACKGROUND OF THE INVENTION

This application claims the priorities of Korean Patent Application No. 2003-55875, filed on Aug. 12, 2003, and Korean Patent Application No. 2003-75806, filed on Oct. 29, 2003, in the Korean Intellectual Property Office, the disclosures of which are incorporated herein in their entireties by reference.

1. Field of the Invention

The present invention relates to methods of driving discharge display panels, and more particularly, to driving methods which include a plurality of sub-fields in a unit frame and perform gradation display through time-division driving.

2. Description of the Related Art

A typical discharge display panel, such as a plasma display panel, is usually configured to have a three-electrode surface discharge structure. Front and rear substrates, usually glass substrates, are provided. A number of address (A) electrodes are formed in parallel on one of the two substrates, and parallel scan (Y) and sustain (X) electrodes are formed in a direction perpendicular to that of the address electrodes on another substrate. Partition walls are formed, for example, on the substrate with the address electrodes, to divide the panel into a number of individual discharge cells. Phosphors are provided between the partition walls. The space between the two substrates is filled with a plasma-generating gas. Discharges between the electrodes generate plasma, the phosphor is excited by the ultraviolet radiation of the plasma, and the discharge cell is thus caused to illuminate.

Plasma panels such as those described above are driven so that particular discharge cells are illuminated in order to display an image. Most driving methods employ, sequentially, a resetting step, an addressing step, and a display-sustain step in each unit sub-field. The resetting step is performed to uniformly distribute electric charges in all display cells. The addressing step is performed to create a desired wall voltage in selected cells to display an image. The display-sustain step is performed to apply a predetermined alternating-current voltage to all the X and Y electrode-line pairs so that the selected display cells with the desired wall voltage applied in the addressing step are caused to have display-sustain discharge.

One conventional driving method that is performed is the address-display separation driving method. In the address-display separation driving method, the addressing period and the display-sustain period in each of the sub-fields of a unit frame are separated from each other. In other words, in address-display separation driving, all of the discharge cells are addressed before any of them are discharged. Therefore, there is a relatively long latent period between addressing and discharge, during which wall charges in the display cells may be scattered, which may deteriorate the accuracy of the display-sustain discharges that begin when the addressing period is complete.

SUMMARY OF THE INVENTION

Embodiments according to one aspect of the invention provide a method for driving a three-electrode surface discharge display panel. The method comprises grouping the display electrode-line pairs into at least first and second display electrode-line groups and performing gradation display through time-division driving. The time-division driving comprises addressing the first display electrode-line group as part of a first type of sub-field, performing a display-sustain operation on the first display electrode-line group as part of the first type of sub-field, addressing the second display electrode-line group as part of the first type of sub-field, and performing a common display-sustain operation on the first and second display electrode-line groups as part of the first type of sub-field. The method also comprises addressing the second display electrode-line group as part of a second type of sub-field, performing a display-sustain operation on the second display electrode-line group as part of the second type of sub-field, addressing the first display electrode-line group as part of the second type of sub-field, and performing a common display-sustain operation on the first and second display electrode-line groups as part of the second type of sub-field.

Embodiments according to another aspect of the invention provide a controller for a display panel having a three-electrode surface discharge configuration. The controller is programmed and adapted to drive the display panel in a driving scheme so as to perform gradation display through time-division. The driving scheme comprises at least first and second type sub-fields arranged and configured such that the first and second type sub-fields are used alternately. Each of the first type sub-fields sequentially includes an addressing time for a first display electrode-line group, a display-sustain time for the first display electrode-line group, an addressing time for the second display electrode-line group, and a display-sustain time for the first and second display electrode-line groups. Each of the second type sub-fields sequentially includes an addressing time for the second display electrode-line group, a display-sustain time for the second display electrode-line group, an addressing time for the first display electrode-line group, and a display-sustain time for the first and second electrode-line groups.

Embodiments according to yet another aspect of the invention provide instructions encoded in a machine-readable medium that cause a controller for a three-electrode surface discharge display panel to drive the display panel in a driving scheme so as to perform gradation display through time-division. The driving scheme comprises at least first and second type sub-fields arranged and configured such that the first and second type sub-fields are used alternately. Each of the first type sub-fields sequentially includes an addressing time for a first display electrode-line group, a display-sustain time for the first display electrode-line group, an addressing time for the second display electrode-line group, and a display-sustain time for the first and second display electrode-line groups. Each of the second type sub-fields sequentially includes an addressing time for the second display electrode-line group, a display-sustain time for the second display electrode-line group, an addressing time for the first display electrode-line group, and a display-sustain time for the first and second electrode-line groups.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
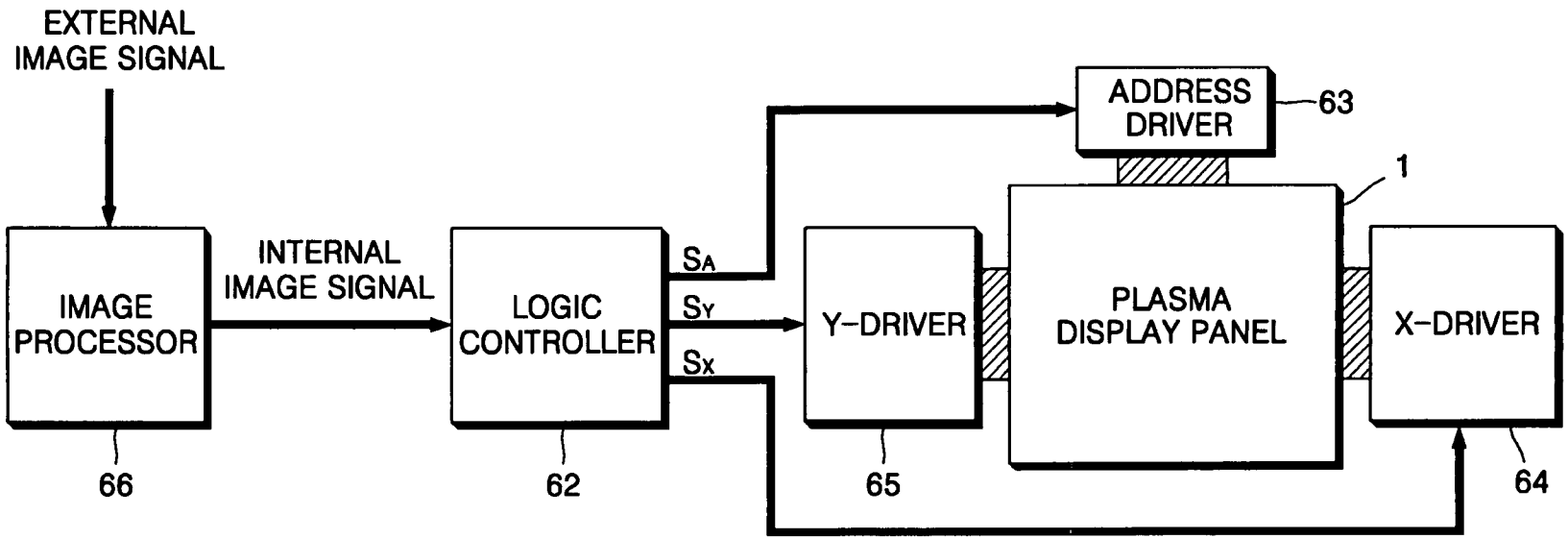
FIG. 1 is a schematic block diagram of an apparatus for driving a plasma display panel in embodiments of the invention.

FIG. 1 illustrates a driving apparatus for driving a conventional plasma display panel according to embodiments of the invention, including an image processor 66, a controller 62, an address driver 63, a X driver 64, and a Y driver 65. The image processor 66 converts external analog image signals into digital signals to generate internal image signals, for example, red (R), green (G), and blue (B) image data each having 8 bits, clock signals, and vertical and horizontal synchronization signals. The controller 62 generates driving control signals $S_A$, $S_Y$, and $S_X$ according to the internal image signals output from the image processor 66. The address driver 63 processes an address signal $S_A$ among the driving control signals $S_A$, $S_Y$, and $S_X$ output from the controller 62, generates a display data signal, and applies the display data signal to the address electrode-lines. The X driver 64 processes a X driving control signal $S_X$ among the driving control signals $S_A$, $S_Y$, and $S_X$ output from the controller 62 and applies the X driving control signal $S_X$ to the X electrode-lines. The Y driver 65 processes a Y driving control signal $S_Y$ among the driving control signals $S_A$, $S_Y$, and $S_X$ output from the logic controller 62 and applies the Y driving control signal $S_Y$ to the Y electrode-lines.

Figure 2:
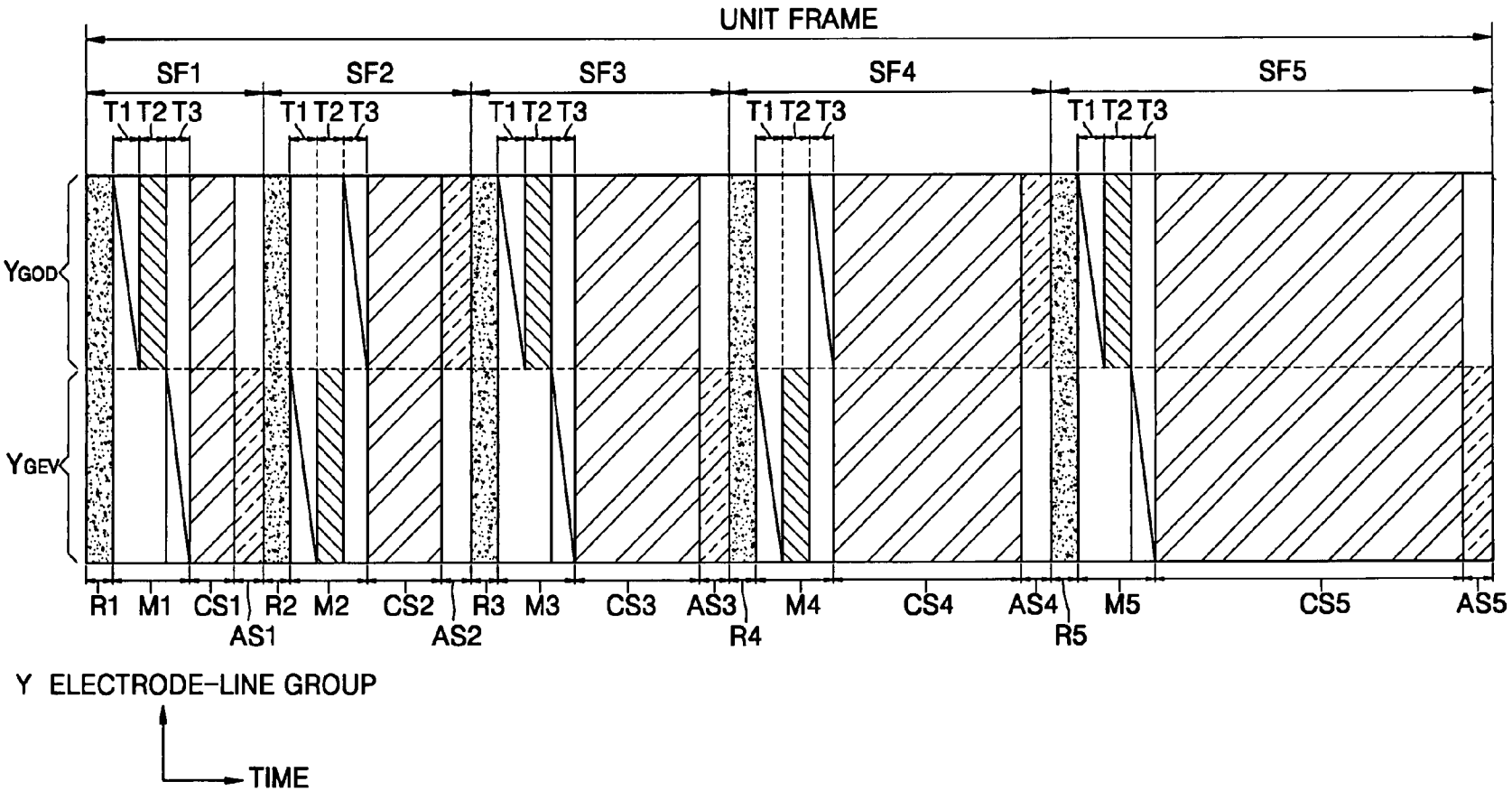
FIG. 2 is a timing diagram illustrating a unit frame used in an address-display mixing driving method according to an embodiment of the present invention.

FIG. 2 is a timing diagram illustrating a unit frame used in an address-display mixing driving method according to an embodiment of the present invention. In FIG. 2, reference signs SF1 through SF5 represent sub-fields allocated in a unit frame, $Y_{GOD}$ represents a first Y electrode-line group including odd numbered electrode-lines, $Y_{GEV}$ represents a second Y electrode-line group including even numbered Y electrode-lines, R1 through R5 represent resetting times, M1 through M5 represent mixing times for which a display-sustain time T2 exists between the addressing times T1 and T3, CS1 through CS5 represent common display-sustain times, and AS1 through AS5 represent compensated display-sustain times.

In FIG. 2, first type sub-fields (SF1, SF3, and SF5) sequentially include resetting times R1, R3, and R5 for the first and second display electrode-line groups $Y_{GOD}$ and $Y_{GEV}$, an addressing time T1 for the first display electrode-line group $Y_{GOD}$, a display-sustain time T2 for the first display electrode-line group $Y_{GOD}$, an addressing time T3 for the second display electrode-line group $Y_{GEV}$, common display-sustain times CS1, CS3, and CS5 for the first and second display electrode-line groups $Y_{GOD}$ and $Y_{GEV}$, and compensated display-sustain times AS1, AS3, and AS5 for the second display electrode-line group $Y_{GEV}$, respectively.

Additionally, second type sub-fields SF2 and SF4 sequentially include resetting times R2 and R4 for the first and second display electrode-line groups $Y_{GOD}$ and $Y_{GEV}$, an addressing time T1 for the second display electrode-line group $Y_{GEV}$, a display-sustain time T2 for the second display electrode-line group $Y_{GEV}$, an addressing time T3 for the first display-electrode-line group $Y_{GOD}$, common display-sustain times CS2 and CS4 for the first and second display electrode-line groups $Y_{GOD}$and $Y_{GEV}$, and compensated display-sustain times AS2 and AS4 for the first display electrode-line group $Y_{GOD}$, respectively.

As such, since the first and second type sub-fields are used alternately, a display-sustain operation of the first display electrode-line group $Y_{GOD}$ does not have a continuous influence on addressing of the second display electrode-line group $Y_{GEV}$ and a display-sustain operation of the second display electrode-line group $Y_{GEV}$ does not have a continuous influence on addressing of the first display electrode-line group $Y_{GOD}$. Accordingly, display uniformity of a plurality of display electrode-line groups can be enhanced.

Hereinafter, operations of each of the first type sub-fields SF1, SF3, and SF5 are described.

During a resetting time R1, R3, or R5, electric charges in all display cells are uniformly distributed.

During a first addressing time T1 in a mixing time M1, M3, or M5, a predetermined wall voltage is created in display cells selected in a first Y electrode-line group $Y_{GOD}$. During a display-sustain time T2 in the mixing time M1, M3, or M5, a predetermined alternating-current voltage is applied to odd numbered XY electrode-line pairs constituting the addressed first Y electrode-line group $Y_{GOD}$, thereby causing display-sustain discharge of the display cells with the predetermined wall voltage selected during the first addressing time T1. During a second addressing time T3 in the mixing time M1, M3, or M5, a predetermined wall voltage is created in display cells selected in a second Y electrode-line group $Y_{GEV}$.

In the mixing time M1, M3, or M5, after the first Y electrode-line group $Y_{GOD}$ is completely addressed, display-sustain discharge for the first Y electrode-line group $Y_{GOD}$ is performed ahead of addressing for the second Y electrode-line group $Y_{GEV}$. Accordingly, latency times until all the display cells of the second Y electrode-line group $Y_{GEV}$ are addressed after all the display cells of the first Y electrode-line group $Y_{GOD}$ are addressed are shortened, which enhances accuracy of display-sustain discharge in a common display-sustain time CS1, CS3, or CS5 beginning when the second addressing time T3 is terminated.

In the common display-sustain time CS1, CS3, or CS5, during a time proportional to a gradation weighted value of its corresponding sub-field, display-sustain discharge is generated in display cells selected among the display cells of the first Y electrode-line group $Y_{GOD}$ and second Y electrode-line group $Y_{GEV}$.

In the compensated display-sustain time AS1, AS3, or AS5, display-sustain discharge is generated during the same time period as the display-sustain time T2 for the first Y electrode-line group $Y_{GOD}$ in display cells selected among the display cells of the second Y electrode-line group $Y_{GEV}$.

Operations of the second type sub-fields SF2 and SF4 are as follows.

During a resetting time R2 or R4, electric charges in all display cells are uniformly distributed.

During a first addressing time T1 in a mixing time M2 or M4, a predetermined wall voltage is created in display cells selected in a second Y electrode-line group $Y_{GEV}$. During a display-sustain time T2 in the mixing time M2 or M4, a predetermined alternating-current voltage is applied to even numbered XY electrode-line pairs constituting the addressed second Y electrode-line group $Y_{GEV}$, thereby causing display-sustain discharge of the display cells with the predetermined wall voltage selected during the first addressing time T1. During a second addressing time T3 in the mixing time M2 or M4, a predetermined wall voltage is created in display cells selected in a first Y electrode-line group $Y_{GOD}$.

In the mixing time M2 or M4, after the second Y electrode-line group $Y_{GEV}$ is completely addressed, display-sustain discharge for the second Y electrode-line group $Y_{GEV}$ is performed before addressing for the first Y electrode-line group $Y_{GOD}$. Accordingly, latency times until all the display cells of the first Y electrode-line group $Y_{GOD}$ are addressed after all the display cells of the second Y electrode-line group $Y_{GEV}$ are addressed are shortened, which enhances accuracy of display-sustain discharge in a common display-sustain time CS2 or CS4 beginning when the second addressing time T3 is terminated.

In the common display-sustain time CS2 or CS4, during a time period whose length is proportional to a gradation weighted value of its corresponding sub-field, display-sustain discharge is generated in display cells selected among the display cells of the first Y electrode-line group $Y_{GOD}$ and second Y electrode-line group $Y_{GEV}$.

In the compensated display-sustain time AS2 or AS4, display-sustain discharge is generated during the same time period as the display-sustain time T2 for the second Y electrode-line group $Y_{GEV}$ in display cells selected among the display cells of the first Y electrode-line group $Y_{GOD}$.

Figure 3:
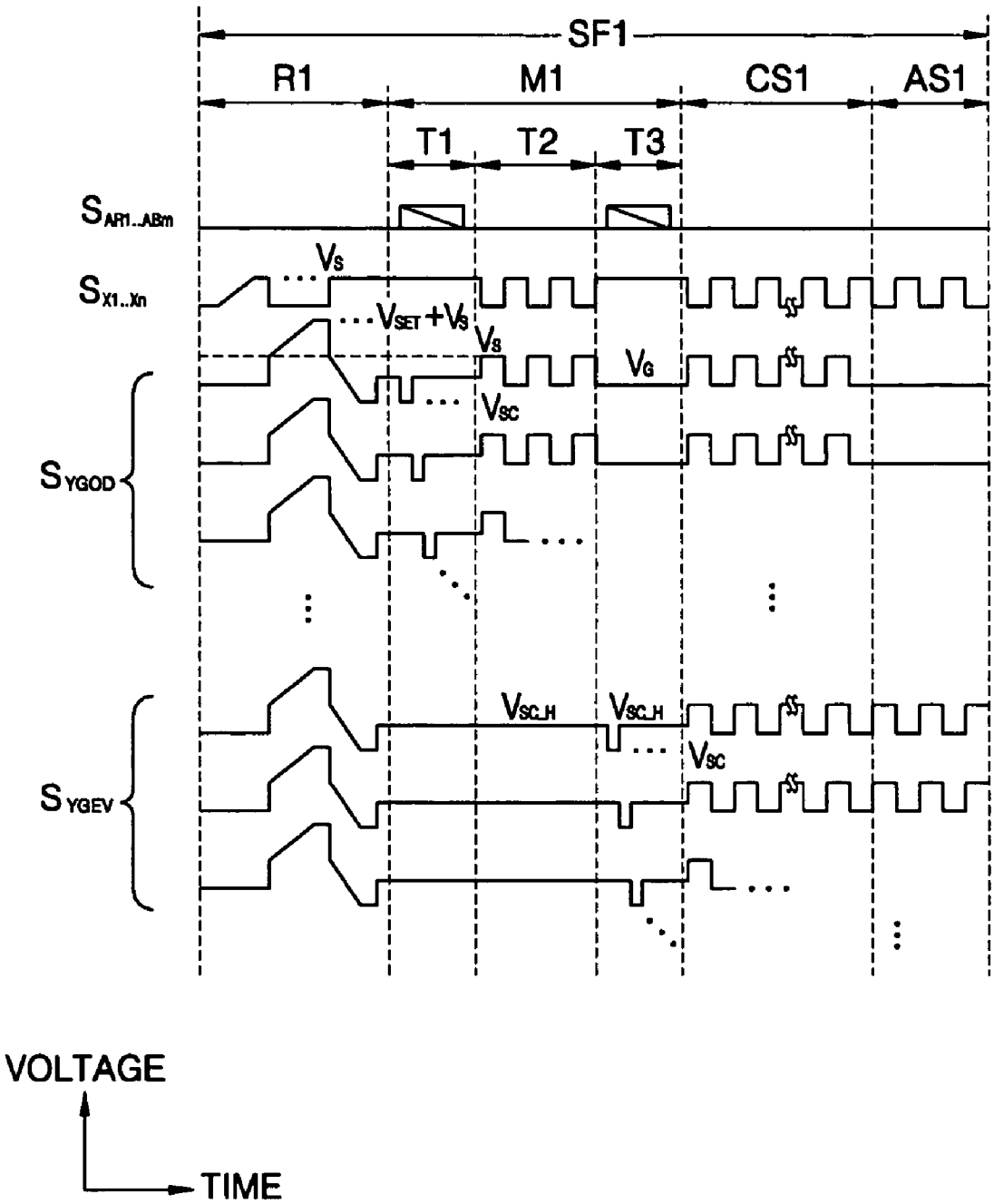
FIG. 3 is a timing diagram showing voltage waveforms of respective driving signals applied to respective electrode-lines in each of the first type of sub-fields (SF1, SF3, and SF5) shown in FIG. 2.

FIG. 3 illustrates voltage waveforms of respective driving signals applied to the respective electrode-lines in each of the first type sub-fields SF1, SF3, and SF5 shown in FIG. 2. In FIG. 3, reference indicators $S_{AR1}, \ldots, {}_{ABm}$ represent display data signals applied from the address driver 63 to the address electrode-lines $A_{R1}$. Reference indicators $S_{X1}$ through $S_{Xn}$ represent driving signals applied from the X driver 64 to all X electrode-lines. Reference indicators $S_{YGOD}$ and $S_{YGEV}$ represent driving signals applied from the Y driver 65 to each of the display electrode-line groups, R1 represents a resetting time, M1 represents a mixing time for which a display-sustain time T2 exists between addressing times T1 and T3, CS1 represents a common display-sustain time, and AS1 represents a compensated display-sustain time.

Figure 4:
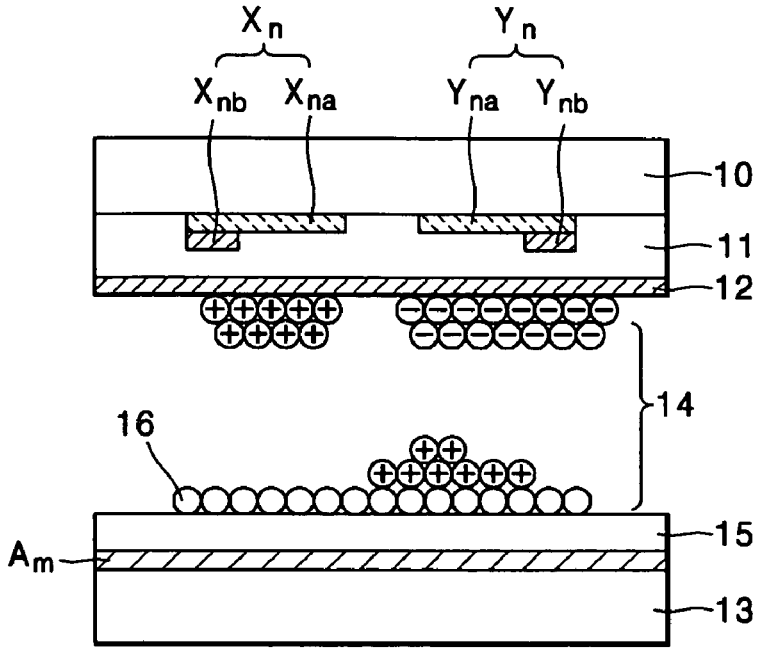
FIG. 4 is a sectional view illustrating the distribution of wall charges of a display cell just after a gradually increasing voltage is applied to Y electrode-lines during a resetting time of FIG. 3.

FIG. 4 is a schematic cross-sectional view of a portion of a discharge cell illustrating the distribution of wall charges just after a gradually increasing voltage is applied to Y electrode-lines in the resetting time R1 of FIG. 3. In the discharge cell, an X electrode $X_n$ and a Y electrode $Y_n$ are provided on a glass substrate 10. The X electrode $X_n$ and the Y electrode $Y_n$ are two-layered structures having a larger first layer $X_{na}$, $Y_{na}$ and a smaller second layer $X_{nb}$, $Y_{nb}$. Both the X electrode $X_n$ and the Y electrode $Y_n$ are covered by a dielectric layer 11, on top of which is disposed a protecting layer 12 that protects the discharge cell from damage due to strong electric fields. The structure of the A electrode $A_m$ on the opposite substrate is similar; the A electrode $A_m$ is provided on a substrate 13 and is covered by another dielectric layer 15. The discharge space 14 of the discharge cell is defined between the protecting layer 12 and the dielectric layer 15 and is filled with a plasma-generating gas.

Figure 5:
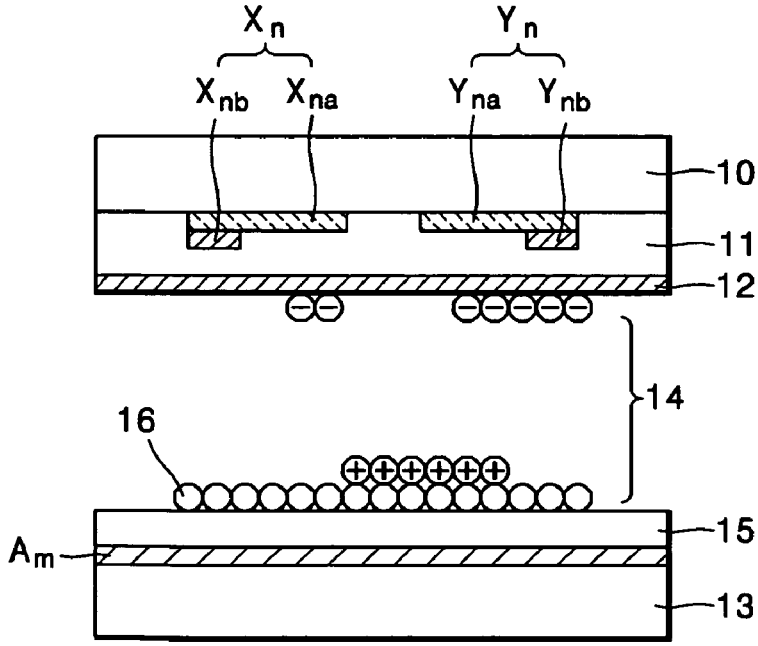
FIG. 5 is a sectional view illustrating the distribution of wall charges of a display cell when the resetting time of FIG. 3 is terminated.

FIG. 5 illustrates the distribution of wall charges of a display cell when the resetting time R1 of FIG. 3 is terminated. The operations of the first type sub-fields SF1, SF3, and SF5 will be described in detail with reference to FIGS. 4 and 5.

As shown in FIG. 3, in a first period of the resetting time R1, the voltage applied to the X electrode-lines $X_1, \ldots, X_n$ increases gradually from a ground voltage $V_G$, to a second voltage $V_S$. At that point, a ground voltage $V_G$ is applied as a third voltage to the Y electrode-lines $Y_1, \ldots, Y_n$ as second display electrode-lines and the address electrode-lines $A_{R1}, \ldots, A_{Bm}$. Accordingly, while generating weak discharge between the X electrode-lines $X_1, \ldots, X_n$ as first display electrode-lines and the Y electrode-lines $Y_1, \ldots, Y_n$ and between the X electrode-lines $X_1, \ldots, X_n$ and the address electrode-lines $A_1, \ldots, A_m$, wall charges with negative polarities are collected around the X electrode-lines $X_1, \ldots, X_n$.

In a second period of the resetting time R1, which is a wall charge accumulating period, the voltage applied to the Y electrode-lines $Y_1, \ldots, Y_n$ increases gradually from the second voltage $V_S$ to a first voltage $V_{SET}+V_s$ higher by a sixth voltage $V_{SET}$ than the second voltage $V_S$. At that point, a ground voltage $V_G$ is applied to the X electrode-lines $X_1, \ldots, X_n$ and the address electrode-lines $A_{R1}, \ldots, A_{Bm}$. Therefore, a weak discharge is generated between the Y electrode-lines $Y_1, \ldots, Y_n$ and the X electrode-lines $X_1, \ldots, X_n$, and a weaker discharge is generated between the Y electrode-lines $Y_1, \ldots, Y_n$ and the address electrode-lines $A_{R1}, \ldots, A_{Bm}$. The reason why the discharge between the Y electrode-lines $Y_1, \ldots, Y_n$ and the X electrode-lines $X_1, \ldots, X_n$ is stronger than the discharge between the Y electrode-lines $Y_1, \ldots, Y_n$ and the address electrode-lines $A_{R1}, \ldots, A_{Bm}$ is because wall charges with negative polarities are collected around the X electrode-lines $X_1, \ldots, X_n$. Accordingly, many wall charges with negative polarities are collected around the Y electrode-lines $Y_1, \ldots, Y_n$, wall charges with positive polarities are collected around the X electrode-lines $X_1, \ldots, X_n$, and a small amount of wall charges with positive polarities are collected around the address electrode-lines $A_{R1}, \ldots, A_{Bm}$, as shown in FIG. 4.

In a third period of the resetting time R1, which acts as a wall charge distribution period, while the second voltage $V_S$ is applied to the X electrode-lines $X_1, \ldots, X_n$, the voltage applied to the Y electrode-lines $Y_1, \ldots, Y_n$ decreases gradually from the second voltage $V_S$ to a negative-polarity voltage $V_{sc}$. At that point, the ground voltage $V_G$ is applied to the address electrode-lines $A_{R1}, \ldots, A_{Bm}$. Therefore, because of the weak discharge between the X electrode-lines $X_1, \ldots, X_n$ and the Y electrode-lines $Y_1, \ldots, Y_n$, a portion of the wall charges with negative polarities around the Y electrode-lines $Y_1, \ldots, Y_n$ accumulates around the X electrode-lines $X_1, \ldots, X_n$, as shown in FIG. 5.

Thus, the wall electric potential of the X electrode-lines $X_1, \ldots, X_n$ becomes lower than the wall electric potential of the address electrode-lines $A_{R1}, \ldots, A_{Bm}$ and also becomes higher than the wall electric potential of the Y electrode-lines $Y_1, \ldots, Y_n$. Therefore, it is possible to reduce the addressing voltage $V_A$-$V_G$ required for opposite discharge between the Y electrode-lines and address electrode-lines selected in the following addressing time A.

During a first period T1 in the mixing time M1, the first Y electrode-line group $Y_{GOD}$ is addressed. During the addressing of $Y_{GOD}$, while the second voltage $V_S$ is applied to all the X electrode-lines $X_1, \ldots, X_n$, the negative-polarity voltage $V_{SC}$ is applied as a scanning voltage to the odd numbered Y electrode-lines constituting the first display electrode-line group $Y_{GOD}$. Simultaneously, display data signals are applied to the address electrode-lines $A_{R1}, \ldots, A_{Bm}$. Accordingly, a predetermined wall voltage is created in selected display cells of the first Y electrode-line group $Y_{GOD}$. Specifically, a wall potential with a positive polarity is created around the Y electrodes of the selected display cells and a wall potential with a negative polarity is created around the address electrodes of the selected display cells. Although no scanning voltage is applied, a bias voltage $V_{SC_H}$ with a positive polarity is applied to all the Y electrode-lines $Y_1, \ldots, Y_n$.

During a second period T2 of the mixing time M1, display-sustain is performed for the first Y electrode-line group $Y_{GOD}$, which has been completely addressed. During the display-sustain period, an alternating-current voltage is applied to X electrode-lines and Y electrode-lines corresponding to the first Y electrode-line group $Y_{GOD}$. Specifically, pulses of the second voltage $V_S$ are alternately applied to odd numbered Y electrode-lines and X electrode-lines which constitute the first display electrode-line group.

According to the above-described driving method, in a third period T3 of the mixing time M1, addressing for the second Y electrode-line group $Y_{GEV}$ is performed.

In the common display-sustain time CS1 which is set proportional to a gradation weighted value of its corresponding sub-field (for example, SF1), display-sustain discharge for all the display electrode-line groups is performed. That is, an alternating-current voltage is applied to all XY electrode-line pairs $X_1Y_1$ through $X_nY_n$.

In the compensated display-sustain time AS1, an alternating-current voltage is applied to XY electrode-line pairs corresponding to the second Y electrode-line group $Y_{GEV}$ during the same time period as the second period T2 of the mixing time M1. Here, since only the ground voltage $V_G$ is applied to the Y electrode-lines of the first display electrode-line group $Y_{GOD}$, display-sustain discharge is not generated in the first display electrode-line group $Y_{GOD}$.

Figure 6:
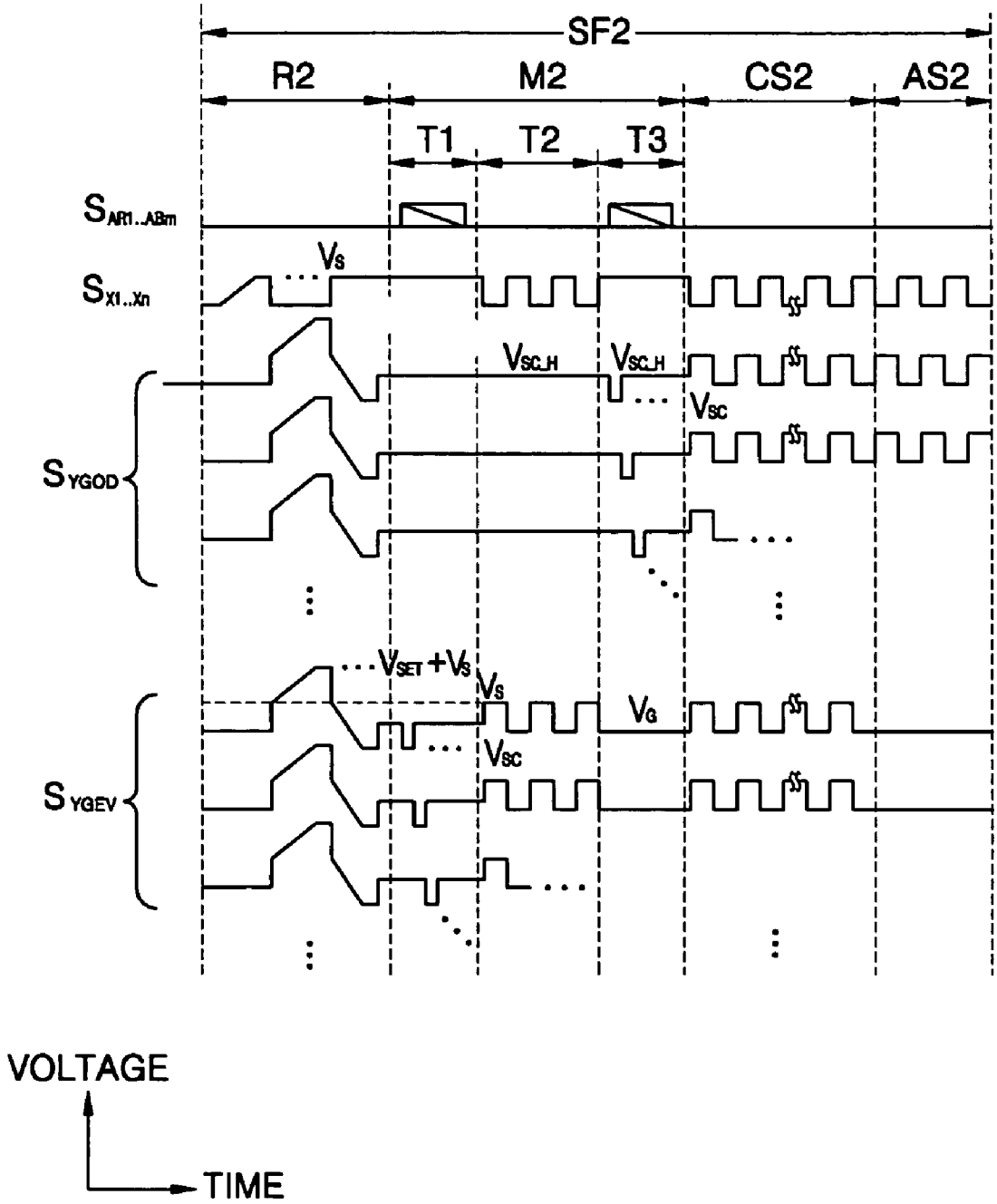
FIG. 6 is a timing diagram illustrating voltage waveforms of respective driving signals applied to respective electrode-lines in each of the second type of sub-fields (SF2 and SF4) shown in FIG. 2.

FIG. 6 illustrates voltage waveforms of respective driving signals applied to the respective electrode-lines in each of the second type sub-fields (SF2 and SF4) that are shown in FIG. 2. In FIG. 6, parameters having the same reference characters as those of FIG. 3 have the same functions as those of the respective parameters of FIG. 3.

The operations during the resetting time R2 were described above in the context of the description for the resetting time R1 of FIG. 3.

During a first period T1 in a mixing time M2, the second Y electrode-line group $Y_{GEV}$ is addressed. In that process, while the second voltage $V_S$ is applied to all the X electrode-lines $X_1, \ldots, X_n$, a negative-polarity voltage $V_{SC}$ is sequentially applied to the even numbered Y electrode-lines constructing the second display electrode-line group $Y_{GEV}$ as a scanning voltage. Simultaneously, display data signals are applied to the address electrode-lines $A_{R1}, \ldots, A_{Bm}$. Accordingly, a predetermined wall voltage is created in selected display cells of the second Y electrode-line group $Y_{GEV}$. Specifically, a wall potential with a positive polarity is created around the Y electrodes of the selected display cells and a wall potential with a negative polarity is created around the address electrodes of the selected display cells. Although no scanning voltage is applied, a bias voltage $V_{SC_H}$ with a positive polarity is applied to all the Y electrode-lines $Y_1, \ldots, Y_n$.

During a second period T2 in the mixing time M2, display-sustain is performed for the second Y electrode-line group $Y_{GEV}$, which has been completely addressed. In that process, an alternating-current voltage is applied to X electrode-lines and Y electrode-lines corresponding to the second Y electrode-line group $Y_{GEV}$. Specifically, pulses of the second voltage $V_S$ are alternately applied to even numbered Y electrode-lines and X electrode-lines which constitute the second display electrode-line group.

According to the above-described driving method, in a third period T3 of the mixing time M2, addressing for the first Y electrode-line group $Y_{GOD}$ is performed.

In the common display-sustain time CS2, which is set proportional to a gradation weighted value of its corresponding sub-field (for example, SF2), display-sustain discharge is performed for all the display electrode-line groups. That is, an alternating-current voltage is applied to all XY electrode-line pairs $X_1Y_1$ through $X_nY_n$.

In the compensated display-sustain time AS2, an alternating-current voltage is applied to XY electrode-line pairs corresponding to the first Y electrode-line group $Y_{GOD}$ during the same time period as the second period T2 of the mixing time M2. In this case, since only the ground voltage $V_G$ is applied to the Y electrode-lines of the second display electrode-line group $Y_{GEV}$, display-sustain discharge is not generated in the second display electrode-line group $Y_{GEV}$.

Figure 7:
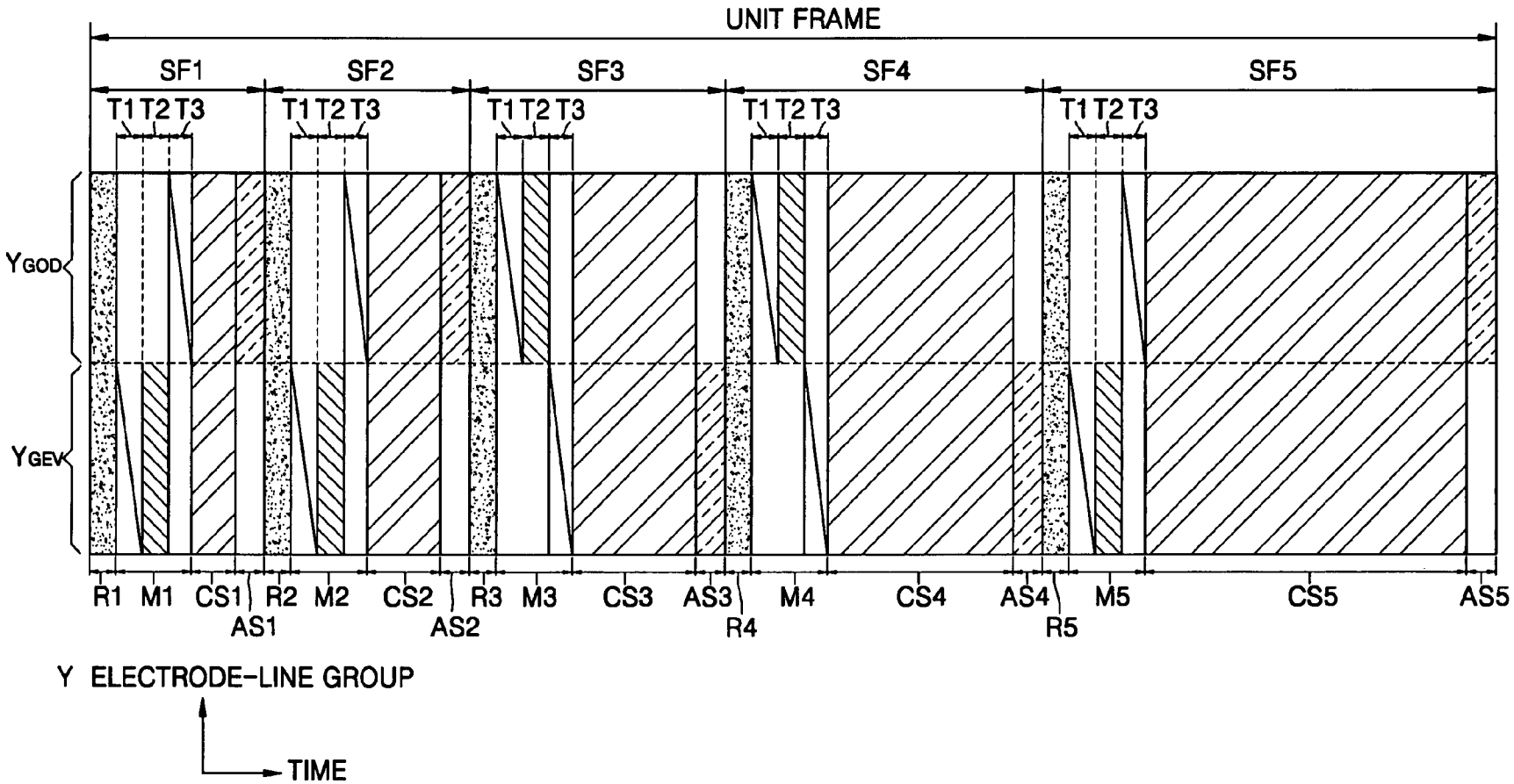
FIG. 7 is a timing diagram illustrating a unit frame used in an address-display mixing driving method according to another embodiment of the present invention.

FIG. 7 illustrates a unit frame used in an Address-Display Mixing driving method according to another embodiment of the present invention. In FIG. 7, parameters having the same reference characters as those of FIG. 2 have the same functions as those of the respective parameters of FIG. 2. In the embodiment shown in FIG. 7, in contrast to that shown in FIG. 2, third and fourth sub-fields SF3 and SF4 are the first type sub-fields and first, second, fifth sub-fields SF1, SF2, and SF5 are the second type sub-fields. A method for driving these first and second type sub-fields was described above with reference to FIGS. 2 through 6.

In methods of discharge display panel driving according to embodiments of the present invention, in each of the first type sub-fields, after the first display electrode-line group is completely addressed, display-sustain discharge for the first display electrode-line group is performed ahead of addressing for the second display electrode-line group. Similarly, in each of the second type sub-fields, after the second display electrode-line group is completely addressed, display-sustain discharge for the second display electrode-line group is performed ahead of addressing for the first display electrode-line group. Accordingly, after all the display cells of each of the XY electrode-line pairs are addressed, latency times waiting until all the display cells of different XY electrode-line pairs are addressed are shortened, which enhances accuracy of display-sustain discharge in the display-sustain time beginning when the addressing time is terminated.

Additionally, since the first and second type sub-fields are used alternately over the span of at least a sub-field, the display-sustain operation of the first display electrode-line group does not have a continuous influence on the addressing of the second display electrode-line group, and the display-sustain operation of the second display electrode-line group does not have a continuous influence on the addressing of the first display electrode-line group. Accordingly, display uniformity of a plurality of display electrode-line groups can be enhanced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method for driving a three-electrode surface discharge display panel, comprising:

grouping display electrode-line pairs into at least a first display electrode-line group and a second display electrode-line group; and performing gradation display through time-division driving, said performing comprising:

addressing the first display electrode-line group as part of a first type of sub-field;

performing a display-sustain operation on the first display electrode-line group as part of the first type of sub-field;

addressing the second display electrode-line group as part of the first type of sub-field;

performing a common display-sustain operation on the first display electrode line group and the second display electrode-line group as part of the first type of sub-field;

addressing the second display electrode-line group as part of a second type of sub-field;

performing a display-sustain operation on the second display electrode-line group as part of the second type of sub-field;

addressing the first display electrode-line group as part of the second type of sub-field; and performing a common display-sustain operation on the first display electrode-line group and the second display electrode-line group as part of the second type of sub-field.

2. The method of claim 1, wherein addressing the first display electrode-line group comprises creating a predetermined wall voltage in display cells selected among display cells of the first display electrode-line group.

3. The method of claim 2, wherein performing the display-sustain operation on the first display electrode-line group comprises generating a display-sustain discharge in display cells selected among display cells of the first display electrode-line group.

4. The method of claim 3, wherein performing the display-sustain operation on the first display electrode-line group comprises applying an alternating-current voltage to the display cells of the first display electrode-line group.

5. The method of claim 1, wherein addressing the second display electrode-line group comprises creating a predetermined wall voltage in display cells selected among display cells of the second display electrode-line group.

6. The method of claim 5, wherein performing the display-sustain operation on the second display electrode-line group comprises generating a display-sustain discharge in display cells selected among display cells of the second display electrode-line group.

7. The method of claim 6, wherein performing the display-sustain operation on the second display electrode-line group comprises applying an alternating-current voltage to the display cells of the second display electrode-line group.

8. The method of claim 1, wherein performing the common display-sustain operation on the first display electrode-line group and the second display electrode-line group comprises generating a display-sustain discharge in display cells selected among display cells of the first display electrode line group and the second display electrode line group.

9. The method of claim 8, wherein performing the common display-sustain operation on the first display electrode-line group and the second display electrode-line group comprises applying an alternating-current voltage to the display cells of the first display electrode line group and the second display electrode-line group.

10. The method of claim 1, further comprising resetting all display cells of at least the first display electrode line group and the second display electrode-line group such that electric charges are uniformly distributed before the addressing of the first display electrode-line group begins.

11. The method of claim 1, further comprising resetting all display cells of at least the first display electrode line group and the second display electrode-line group such that electric charges are uniformly distributed before addressing the second display electrode-line group.

12. The method of claim 1, wherein the common display-sustain operation of the first type of sub-field is performed for a time proportional to a gradation weighted value of its corresponding sub-field, after the display-sustain operation on the first display electrode line group is terminated and the second display electrode-line group is addressed.

13. The method of claim 12, further comprising performing a compensated display-sustain operation as part of the first type of sub field in which display-sustain discharge is generated in selected display cells of the second display electrode-line group during a time period in which the display-sustain operation on the first display electrode-line group is performed, after the common display-sustain operation is terminated.

14. The method of claim 1, wherein the common display-sustain operation of the second type of sub-field is performed for a time proportional to a gradation weighted value of its corresponding sub-field, after the display-sustain operation on the second display electrode-line group is terminated and the first display electrode line group is addressed.

15. The method of claim 14, further comprising performing a compensated display-sustain operation as part of the second type of sub-field in which display-sustain discharge is generated in selected display cells of the first display electrode-line group during a time period in which the display-sustain operation on the second display electrode-line group is performed, after the common display-sustain operation is terminated.

16. The method of claim 1, further comprising performing a compensated display-sustain operation as part of the first type of sub-field, in which display-sustain discharge is generated in display cells selected among display cells of the second display electrode-line group during a time period in which the display-sustain operation for the first display electrode-line group is performed, after the common display-sustain operation is terminated.

17. The method of claim 1, further comprising performing a compensated display-sustain operation as part of the second type of sub-field, in which display-sustain discharge is generated in display cells selected among display cells of the first display electrode-line group during a time period when the display-sustain operation for the second display electrode-line group is performed, after the common display-sustain operation is terminated.

18. The method of claim 1, wherein the first type of sub-field and the second type of sub-field are used alternately in a span of at least one frame.

19. The method of claim 1, wherein tasks for each type of sub-field are performed sequentially.

20. A controller for a display panel having a three-electrode surface discharge configuration, the controller being programmed and adapted to drive the display panel in a driving scheme so as to perform gradation display through time-division, the driving scheme comprising at least a first type sub-field and a second type sub-field arranged and configured such that:

the first type sub-field and the second type sub-field are used alternately;

the first type sub-field sequentially includes an addressing time for a first display electrode-line group, a display-sustain time for the first display electrode-line group, an addressing time for a second display electrode-line group, and a display-sustain time for the first display electrode line group and the second display electrode-line group; and the second type sub-field sequentially includes an addressing time for the second display electrode-line group, a display-sustain time for the second display electrode-line group, an addressing time for the first display electrode-line group, and a display-sustain time for the first display electrode line group and the second electrode-line group.

21. Instructions encoded in a machine-readable medium that cause a controller for a three-electrode surface discharge display panel to drive the display panel in a driving scheme so as to perform gradation display through time-division, the driving scheme comprising at least a first type sub-field and a second type sub-field arranged and configured such that:

the first type sub-field and the second type sub-field are used alternately;

the first type sub-field sequentially includes an addressing time for a first display electrode-line group, a display-sustain time for the first display electrode-line group, an addressing time for a second display electrode-line group, and a display-sustain time for the first and second display electrode-line groups; and the second type sub-field sequentially includes an addressing time for the second display electrode-line group, a display-sustain time for the second display electrode-line group, an addressing time for the first display electrode-line group, and a display-sustain time for the first and second electrode-line groups.

* * * * *